United States Patent [19]

Brant

[11] Patent Number: 5,058,885

[45] Date of Patent: Oct. 22, 1991

[54] WARMUP AID BALL

[76] Inventor: William A. Brant, 827 Arizona Ash, San Antonio, Tex. 78232

[21] Appl. No.: 549,908

[22] Filed: Jul. 9, 1990

[51] Int. Cl.[5] ..... A63B 11/00

[52] U.S. Cl. ..... 272/122; 273/58 K; 272/108; 272/67; 272/68

[58] Field of Search ..... 272/67, 122, 114, 117, 272/68 C, 67, 124; 273/58 C, 14, 17, 18, 20, 58 K, DIG. 8, 26 R, 65 R, 65 EG, 55 R, 165, 166, 26 D, 58 R, 58 B, 58 F, DIG. 20

[56] References Cited

U.S. PATENT DOCUMENTS

| | | | |
|---|---|---|---|
| 855,016 | 5/1907 | Orthwein | 273/165 |
| 2,664,289 | 3/1952 | Norwich | 273/58.12 |
| 3,734,493 | 5/1973 | Hasekian | 272/84 |

FOREIGN PATENT DOCUMENTS

| | | | |
|---|---|---|---|
| 517950 | 8/1938 | United Kingdom | 272/57 |

*Primary Examiner*—Richard J. Apley
*Assistant Examiner*—Jerome Donnelly
*Attorney, Agent, or Firm*—Gunn, Lee & Miller

[57] ABSTRACT

A warmup aid ball having an outer shell, an inner weighted core, and a multiplicity of contiguous finger retaining loops in a side-by-side lateral arrangement. Each separate loop is attached to the outer shell at a base portion. The base portions of the end loops are arcuated at the area where the base attaches to the outer shell of the ball to accommodate those digits not retained in a loop in a position to eliminate irritation and discomfort. Each loop is slightly displaceable, side-to-side to facilitate varying hand and finger sizes.

5 Claims, 2 Drawing Sheets

WARMUP AID BALL

BACKGROUND OF THE INVENTION

This invention relates to a physical training apparatus, and more particularly to a weighted ball having a multiplicity of contiguous finger loops. The apparatus is specifically designed to aid in precompetitive warmup drills by allowing the user to practice a full throwing motion including release and follow through without a receiver or catcher.

The current method for a thrower to warm up involves pitching or passing a ball back and forth to a catcher or receiver, thus requiring at least one participant other than the thrower. While a thrower may be able to go through all of the prerelease steps involved in throwing a ball, he cannot actually open his hand as required in release unless he has a catcher or other retrieval means.

In addition to being able to go through the full throwing motion, it is also desirable to provide the thrower with resistance at least equal to the official weight of the implement being thrown in competition. Increased strength and endurance may be achieved by training with an implement heavier than those used in competition. The present invention enables the thrower to train for competition or warmup prior to competition with a weighted ball, without the aid of a receiver, and to employ a full pitching or throwing motion.

Weighted exercise balls are known in the art and are best illustrated by U.S. Pat. No. 777,478. U.S. Pat. No. 777,478 further teaches the attachment of carrying handles on the surface of a ball; however, the handles are positioned at opposite sides of the ball surface and are intended to assist the user in moving a heavily weighted spherical object.

Another type of exercising device is disclosed in U.S. Pat. No. 2,664,289. In this device a small rubber ball is provided with a single, finger-engaging handle. The device is intended to be alternately compressed and released to strengthen the fingers, hands, wrists and forearms. The device is not weighted and does not employ a multiplicity of contiguous finger loops shown in the present invention.

SUMMARY OF THE INVENTION

The present invention provides the user with both the weighted feature and the finger engaging aspects of the prior art in a unique and unobvious combination.

The present invention is a warmup aid or training ball having an outer shell of material composition substantially equal to or identical with the official ball or implement to be thrown in competition. A means for increasing or decreasing the weight of the ball is provided in the inner section or portion of the ball. A multiplicity of contiguous finger retaining loops are attached to the outer shell of the ball in a lateral side-by-side arrangement to accommodate the fingers of the thrower. Each separate loop is flexible enough to ensure slight variations in the distance between the side-by-side loops based upon the finger and hand size of the user. Further end loops of the device have along their outside-surface or wall an inwardly arcuated portion or curvature formed therein immediately above the point where the loop base attaches to the ball shell.

By configuring the finger loops in a contiguous arrangement over the surface of the ball and by ensuring that the outermost finger loops have inwardly arcuated portions at the base of the loops, the present invention allows the user to move a weighted ball through the full throwing motion without the ball slipping from the grasp or irritating any adjacent digits not retained in a finger loop.

The present invention is adaptable to spherical balls of all diameters intended to be manipulated principally with one hand, e.g., baseballs, softballs, basketballs and bowling balls. The present invention is further useful with game balls having a longitudinal axis longer than a lateral axis, such as a football, as will be noted below.

BRIEF DESCRIPTION OF THE DRAWINGS

In describing the invention in detail, reference is had to the accompanying drawings, forming a part of this specification, and wherein like numerals of reference indicate corresponding parts throughout the several views in which.

DETAILED DESCRIPTION OF THE PREFERRED EMBODIMENT

Figure 1:
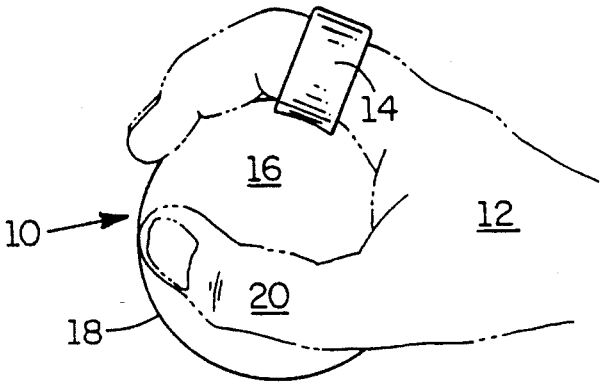
FIG. 1 is a left side perspective view of the present invention being grasped by a righthanded thrower.

FIG. 1 illustrates a perspective view of the present invention 10 being grasped by the right hand 12 of the thrower. End finger retaining loop 14 is shown attached to the outer shell 16 of spherical ball 18. Thumb 20 is positioned to avoid interference with loop 14. Loop 14 is made of tough, flexible material such as plastic, but reinforced leather or other suitable compositions may be employed.

Figure 2:
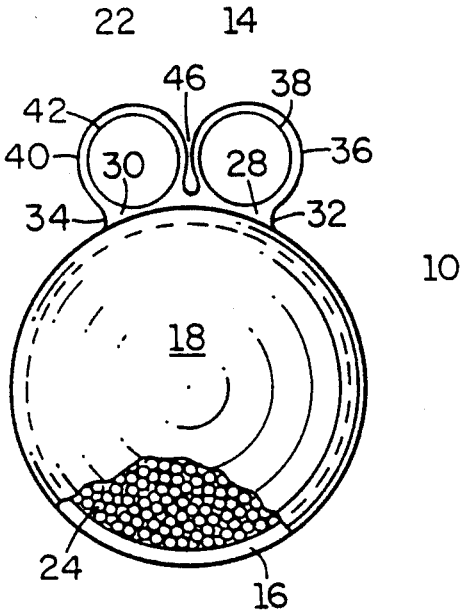
FIG. 2 is a side elevation illustration of the present invention with a cut-away portion showing the weighting inside the ball.

As may be seen in FIG. 2, loop 14 is one of a multiplicity of contiguous loops (contiguous end loops 14 and 22 are illustrated) attached to the outer shell 16 of ball 18. Inside of ball 18 in an inner core portion of ball 18 may be placed any suitable quantity of weight. FIG. 2 illustrates the use of small lead shot or pellets as a weighting means. However, it should be understood that any material could be disposed inside of shell 16 to vary the overall weight of ball 18. Ball 18 may be covered over the shell 16 with any material composition (not shown), but preferably the ball 18 is covered with the same materials as are used on balls utilized in competition.

Loops 14 and 22 have approximately a 1" opening and the walls of the loops are approximately ⅛" in thickness. Ball 18 is approximately 2¾" in diameter and the approximate distance from the outside surface 40 of loop 22 to the outside surface 36 of loop 14 is 2½".

It is taught herein that loops 14 and 22 are preferably attached to the outer shell 16 rather than the cover, but if suitable materials are used for the cover, loops 14 and 22 attachment may be made directly to the covering material.

Figure 4:
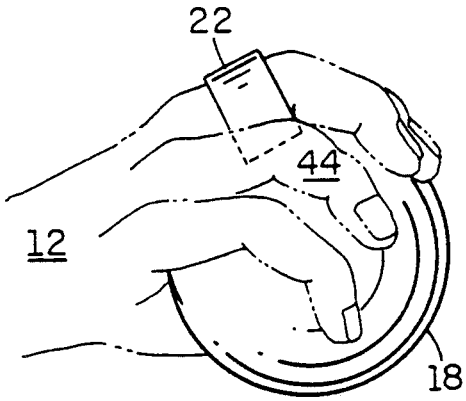
FIG. 4 is a right side perspective view of the present invention being grasped by a righthanded thrower.

At the base 28 of loop 14 and base 30 of loop 22 there are found arcuated shoulder portions 32 and 34, respectively. Arcuation 32 is in the outside surface 36 of the wall 38 of loop 14, and arcuation 34 is similarly formed in the outside surface 40 of wall 42 of loop 22. The purpose of the arcuation in the end loops 14 and 22 is to accommodate the placement of digit not being retained by the loops. In FIG. 4, the ring finger 44 of hand 12 is able to fit comfortably around the ball 18 without irritation or awkward and unnatural positioning of the hand. Were the outside wall of the loop straight, an unyielding and disadvantageous interference would be created by the loops. Having a straight side wall is not a problem where a device is used merely for compression and release (as seen in U.S. Pat. No. 777,478) but where the user is attempting to create a natural, regular pitching or throwing grip a straight side wall creates a real problem.

Space 46 between the loops 14 and 22 may vary slightly according to the size of the fingers and hand of the thrower. In some cases the loops may be pressed into side-by-side contact. The loops are flexible enough to give some side-to-side flexing or displacement. While it is not illustrated in the drawings, it should be understood that any number of methods or means may be used to provide a snug or close fit of the inner surfaces of loops 14 and 22 around the user's digit. (U.S. Pat. No. 777,748 teaches the use of a fin member and is incorporated herein for all purposes.)

Figure 3:
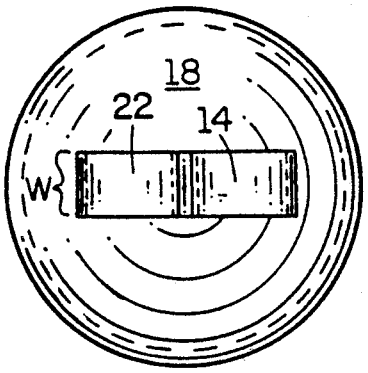
FIG. 3 is a top view of the present invention.

The top view illustrated in FIG. 3 shows the lateral side-by-side arrangement of the loops 14 and 22. Space 46 is shown closed to accommodate fingers which are closer together. The width, W, of the loops is approximately ½" which ensures that the loop fits securely to the finger. Further, it will be noticed in FIG. 3 that the arrangement of loops 14 and 22 on ball 18 allow for plenty of room for the placement of non-retained digits along the side portions of the ball. This is particularly critical in ensuring that the thrower may use a normal, unrestricted grip.

In those circumstances where more than two loops are placed continguous in a lateral side-by-side arrangement, as with, for example, a basketball, the end loops would be provided with the arcuations previously discussed so that any unrestrained digit is comfortably positionable on the ball.

Figure 5:
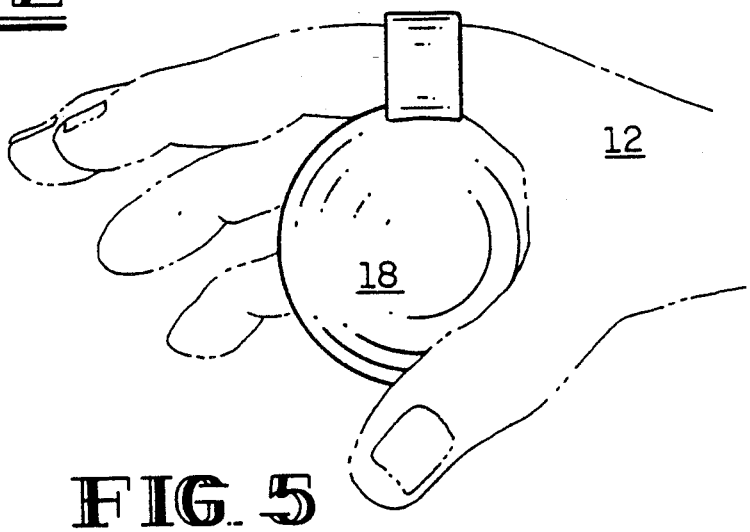
FIG. 5 is a left side perspective view of the present invention being released by a righthanded thrower.

In FIG. 5, it is illustrated how the thrower may freely release the ball and not have the ball disengage from the hand. The use of a multiplicity of contiguous loops in side-by-side lateral arrangement ensures that a weighted ball will not slip off the fingers.

Figure 6:
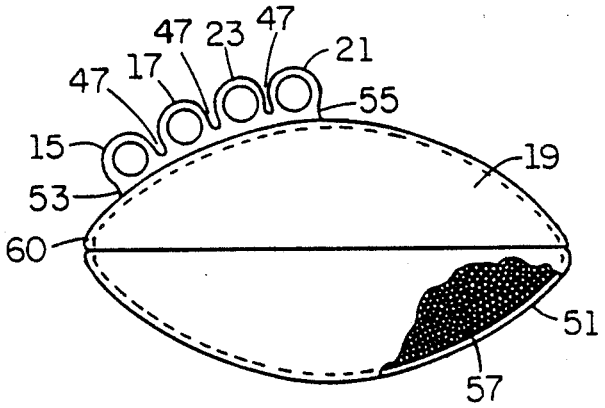
FIG. 6 is a side elevation illustration of an alternate embodiment of the present invention with a cut-away portion showing the weighting inside the ball.

In an alternate embodiment of the present invention, as shown in FIGS. 6–9, it may be seen how the present invention is applicable to a game ball having a longitudinal axis longer than a lateral axis (as in a football). FIG. 6 shows a ball 19 having four contiguous finger retaining loops 15, 17, 21, 23, attached to the outer shell 51 partially filled with weight 57.

The distance from the back end 60 of ball 19 to the first loop 15 is approximately 2". Each loop has an opening of approximately 1" in diameter, a wall thickness of ⅛", a width of ½", and an at rest spacing between loops of ½".

Figure 7:
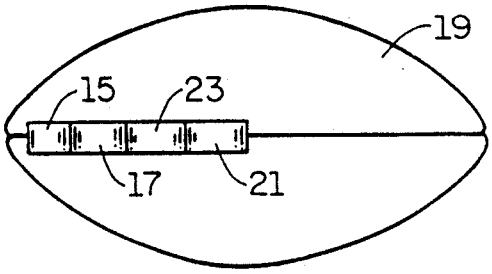
FIG. 7 is a top view of an alternate embodiment of the present invention.

It should be noted that end loops 15 and 21 have arcuated shoulder portions 53 and 55, respectively, formed in their bases near the point of attachment with the shell. Again, the space between loops (reference numeral 47) may vary slightly by side-to-side flexion of adjacent loops. FIG. 7 illustrates the lateral arrangement of the loops.

Figure 8:
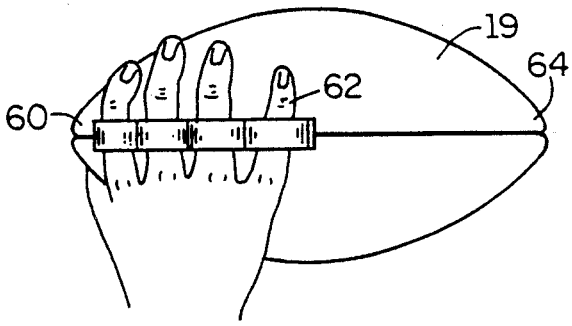
FIG. 8 is a top view of an alternate embodiment of the present invention illustrating the placement of the thrower's hand.
Figure 9:
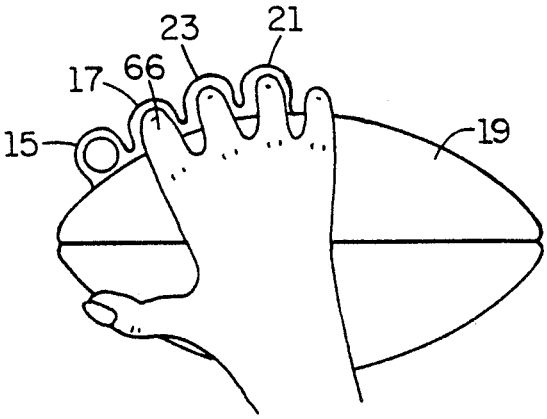
FIG. 9 is a side view of an alternate embodiment of the present invention illustrating an alternative placement of the thrower's hand.

FIGS. 8 and 9 illustrate the versatility of the present invention to accommodate the varying gripping methods of throwers. FIG. 8 illustrates a thrower who grips the ball near the back end 60 of ball 19. Further, this thrower extends the little finger 62 more forward the front end 64 of the ball. This grip variation shown in FIG. 8 may be accommodated because of the side-to-side flexion of the loops.

FIG. 9 illustrates a thrower who grips the ball 19 furthermore forward the back end 60 of ball 19. Forefinger 66 passes through second loop 17 and not first end loop 15, but little finger 62 is positioned outside end loop 21 and comfortably rests in arcuated shoulder portion 55. If only one loop were provided on ball 19 these grip variations would not be available and still provide for adequate control of a weighted ball. Thus, the multiplicity of contiguous loops in a lateral side-by-side arrangement is provided. Further, the arcuated shoulders provide for improved comfort and elimination of digit irritations.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

I claim:

1. A warmup aid ball having a substantially continuously curved outer surface comprising:

an outer curved shell of a size to allow a user to grip and manipulate said ball with one hand;

a means for weighting an inner portion of said ball;

a multiplicity of contiguous finger relating loops extending above the peripheral surface of said ball for securing said ball to a user's hand when said user intentionally releases his grip from said ball during a throwing motion and follow through, said loops in a lateral, side-by-side arrangement along said curved surface, each separate loop of said multiplicity of contiguous finger retaining loops attached at a base portion to said outer shell.

2. A warmup aid ball according to claim 1 wherein said multiplicity of contiguous finger retaining loops further comprises at least a first end loop and at least a second end loop, said first end loop and said second end loop having along outer sides of said end loops inwardly arcuated portions immediately adjacent where said base of said end loops attach to said shell of said ball.

3. A warmup aid ball according to claim 1 wherein each of said separate loops has a slightly variable distance between an immediately adjacent loop through flexible side-to-side displacement of each of said loops.

4. A warmup aid ball according to claim 2 wherein each of said separate loops has a slightly variable distance between an immediately adjacent loop through flexible side-to-side displacement of each of said loops.

5. A warmup aid ball having a substantially continuously curved outer surface comprising:

an outer curved shell of a size to allow a user to grip and manipulate said ball with one hand;

a means for weighting an inner portion of said ball;

a multiplicity of contiguous finger relating loops extending above the peripheral surface of said ball for securing said ball to a user's hand when said user intentionally releases his grip from said ball during a throwing motion and follow through, said loops in a lateral, side-by-side arrangement along said curved surface, each separate loop of said multiplicity of contiguous finger retaining loops attached at a base portion to said outer shell, said multiplicity of contiguous finger retaining loops having at least a first end loop and at least a second end loop, said first end loop and said second end loop having along outsides of said end loops inwardly arcuated portions immediately adjacent where said base of said end loops attaches to said shell of said ball, each of said loops having a slightly variable distance between an immediately adjacent loop through flexible displacement of each of said loops.

* * * * *